US008869451B2

(12) United States Patent
Belyea et al.

(10) Patent No.: US 8,869,451 B2
(45) Date of Patent: Oct. 28, 2014

(54) FINGER GUARD SAFETY DEVICE

(75) Inventors: Vianka P. Belyea, Boston, MA (US); Tavinder Phull, Newton, MA (US)

(73) Assignee: Rhoost, LLC, Newton, MA (US)

( * ) Notice: Subject to any disclaimer, the term of this patent is extended or adjusted under 35 U.S.C. 154(b) by 0 days.

(21) Appl. No.: 13/552,412

(22) Filed: Jul. 18, 2012

(65) Prior Publication Data

US 2013/0118087 A1 May 16, 2013

Related U.S. Application Data

(60) Provisional application No. 61/509,425, filed on Jul. 19, 2011.

(51) Int. Cl.
*E05D 11/00* (2006.01)
*E06B 7/36* (2006.01)

(52) U.S. Cl.
CPC ..... *E06B 7/362* (2013.01)
USPC ..... 49/383; 16/82; 292/288

(58) Field of Classification Search
CPC ..... E05C 17/02; E05C 17/025; E05C 17/203; E05D 11/06; E05F 2005/046
USPC ..... 49/383, 381; 16/82, 83, 85, 86 R, 86 A; 292/288, 342, 343
See application file for complete search history.

(56) References Cited

U.S. PATENT DOCUMENTS 3,174,179 A * 3/1965 Benson ..... 16/375
3,325,854 A * 6/1967 Steigerwald ..... 16/375
4,259,762 A * 4/1981 Civitelli ..... 16/86 B
4,611,429 A 9/1986 Kanies
D286,015 S * 10/1986 Johnson ..... D8/402
4,831,688 A * 5/1989 Deininger ..... 16/319
5,027,471 A * 7/1991 Barnes ..... 16/86 R
5,044,681 A * 9/1991 Neighbors ..... 292/288
D323,976 S * 2/1992 Barnes ..... D8/402
5,450,652 A * 9/1995 Webb ..... 16/82
5,511,837 A * 4/1996 Dempsey et al. ..... 292/288
5,680,675 A * 10/1997 Davis ..... 16/83
5,711,557 A * 1/1998 Nicolosi ..... 292/288
6,311,537 B1 * 11/2001 Vigil ..... 72/392
6,616,128 B2 * 9/2003 Selzer ..... 254/104
D481,625 S * 11/2003 Ellsworth ..... D8/402
6,804,914 B2 * 10/2004 Salzman ..... 49/462
6,948,214 B2 * 9/2005 Spalding et al. ..... 16/82
D538,149 S * 3/2007 Yarde et al. ..... D8/402
7,374,213 B2 * 5/2008 Carlson ..... 292/343
7,506,905 B1 * 3/2009 George ..... 292/343
7,559,114 B2 * 7/2009 Ranilovich ..... 16/82
D604,156 S * 11/2009 Healy ..... D8/402

(Continued)

*Primary Examiner* — Katherine Mitchell
*Assistant Examiner* — Shiref Mekhaeil
(74) *Attorney, Agent, or Firm* — Wilmer Cutler Pickering Hale and Dorr LLP

(57) ABSTRACT

A finger guard device is designed to be inserted into a gap between a hinged door and a doorjamb that is created when the door is at least partially open. The finger guard device includes a wedge and a protuberance from the wedge that is shaped and sized to hook over a hinge of the door. The finger guard device is placed to straddle a hinge so that the wedge extends down one side of a hinge and the protuberance hooks over the other side of the hinge. When the finger guard is so placed, the door can not be completely closed and a gap remains between the door and the doorjamb. This gap prevents injury caused by fingers being pinched in doorjambs.

19 Claims, 10 Drawing Sheets

(56) References Cited

U.S. PATENT DOCUMENTS

| | | | | |
|---|---|---|---|---|
| 7,644,964 | B2 * | 1/2010 | Bushey et al. | 292/342 |
| D611,804 | S | 3/2010 | Davidson | |
| 7,904,992 | B2 * | 3/2011 | Agster et al. | 16/82 |
| D644,086 | S * | 8/2011 | Herglotz et al. | D8/323 |
| D655,144 | S * | 3/2012 | Hajarizadeh | D8/47 |
| 8,191,191 | B2 * | 6/2012 | Montross | 5/660 |
| 8,201,796 | B2 | 6/2012 | Belyea et al. | |
| 8,410,726 | B2 * | 4/2013 | Dau et al. | 315/312 |
| D682,081 | S * | 5/2013 | Crawford | D8/402 |
| 2009/0282741 | A1 * | 11/2009 | Kim | 49/383 |
| 2011/0214355 | A1 * | 9/2011 | Kim | 49/383 |
| 2013/0037643 | A1 | 2/2013 | Belyea et al. | |
| 2013/0118087 | A1 | 5/2013 | Belyea et al. | |

* cited by examiner

FINGER GUARD SAFETY DEVICE

CROSS-REFERENCE TO RELATED APPLICATION

This application claims the benefit of U.S. Provisional Application No. 61/509,425, filed Jul. 19, 2011, the entire contents of which are hereby incorporated by reference.

BACKGROUND

This disclosure generally relates to child safety products that are used with hinged doors to limit or prevent injury caused by fingers being pinched in doorjambs.

Finger guards are used to prevent injury when body parts are inserted into the gap created by a hinged door and frame. These products prevent injury by holding doors in fully or partially open positions.

SUMMARY

A finger-guard safety device (sometimes referred to as a "finger guard") is a safety product that helps prevent injury from a body part, such as fingers, being squeezed or crushed in a doorjamb. The disclosed finger guard is simple to use and inexpensive to make. It is placed over a door hinge to block the free-swinging motion of doors in both directions to prevent the gap formed between the longitudinal inner edge of the door and the inner edge of the doorjamb from becoming small enough to pinch fingers.

The finger guard includes (and can consist or consist essentially of) a wedge and a protuberance. The wedge portion of the device rests on one side of the hinge and the protuberance goes through the gap to rest on the other side of the hinge such that the device straddles the hinge. When the door is forced open or closed, the inner edges of the door and the doorjamb meet resistance from the wedge or the protuberance, thereby maintaining the gap between them.

Embodiments of the invention can provide protection from pinched fingers when a child is on either the hinge or doorknob sides of the door. Embodiments can also include a safety device in combination with a hinge, or in combination with a hinge and a door, and a doorjamb.

BRIEF DESCRIPTION OF THE DRAWINGS

The following figures are provided for the purpose of illustration only and are not intended to be limiting.

DETAILED DESCRIPTION

The disclosed finger guard 10, which includes, and can consist of or consist essentially of, a wedge 12 and a protuberance 14, is positioned on a door hinge of an installed door to prevent the door from potentially causing injury to body parts, such as fingers. The finger guard 10 helps prevent injury by keeping open the gap between a longitudinal inner edge of the door and an inner edge of a doorjamb. Doors typically have two to three hinges at regularly spaced intervals. The finger guard 10 is installed over the hinge, preferably over the top-most hinge to avoid calling the attention of, or being removed by, children or others. Once installed, the finger guard 10 blocks the free-swinging motion of the door in both directions. The door can be considered blocked sufficiently when a gap between the longitudinal inner edge of the door and the inner edge of the doorjamb is maintained such that the gap is at least great enough for a child's fingers to pass through, or preferably not less than about 0.25 inches (approx. 0.6 cm) to about 0.5 inches (approx. 1.25 cm) wide.

Figure 7:
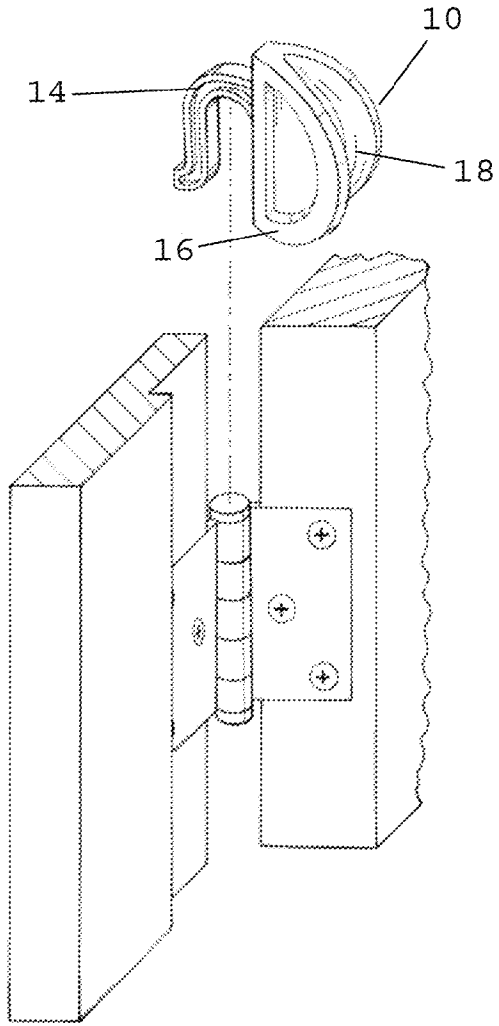
FIGS. 7 and 8 are side perspective views of a finger guard in use.
Figure 8:
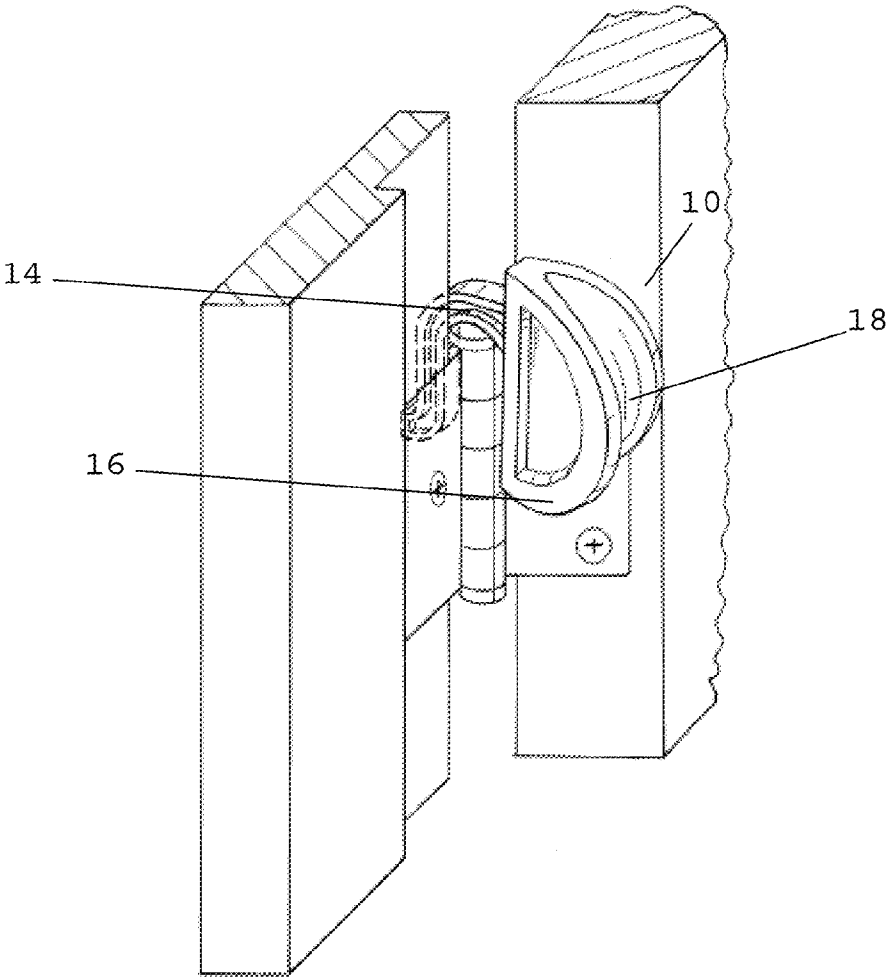

To install the finger guard 10, the device 10 straddles the door hinge such that the protuberance 14 and wedge 12 extend down opposite sides of the hinge, and the wedge 12 is lodged into the gap between the longitudinal inner edge of the door and the inner edge of the doorjamb as shown in FIGS. 7 and 8. The finger guard 10 is held in place by the protuberance 14 and friction between the wedge 14, door, and doorjamb. The device 10 can removed and reused without defacing or damaging the finger guard 10, door, hinges, frame, or doorjamb. No hardware, adhesives, or tools are required to mount or remove the finger guard 10.

Figure 1:
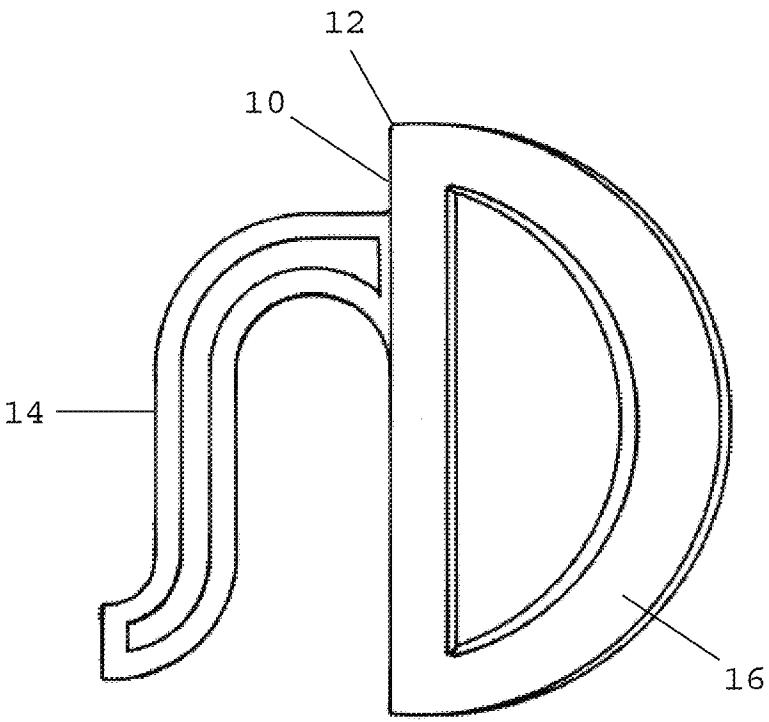
FIG. 1 is a side perspective view of a finger guard.
Figure 2:
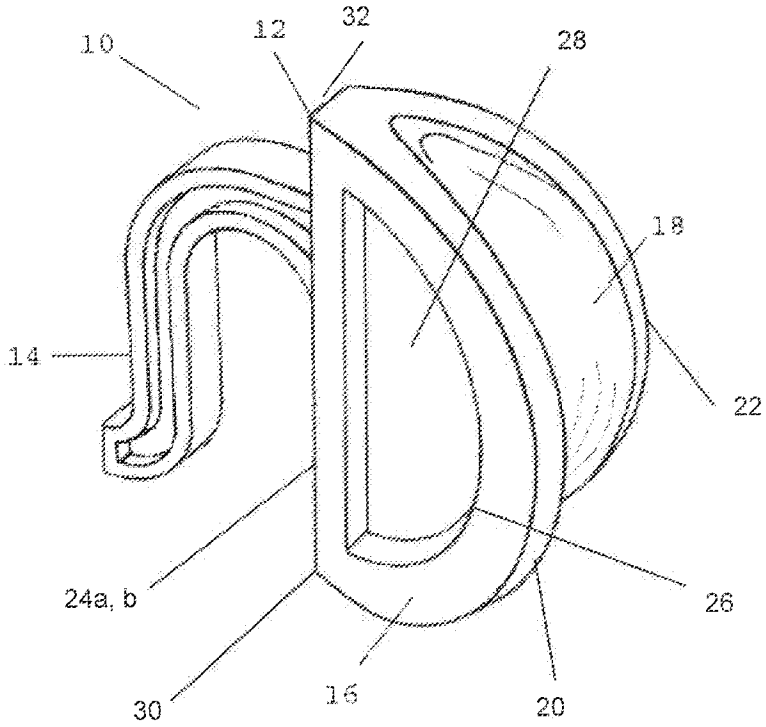
FIG. 2 is a rear perspective view of the finger guard of FIG. 1.
Figure 4A:
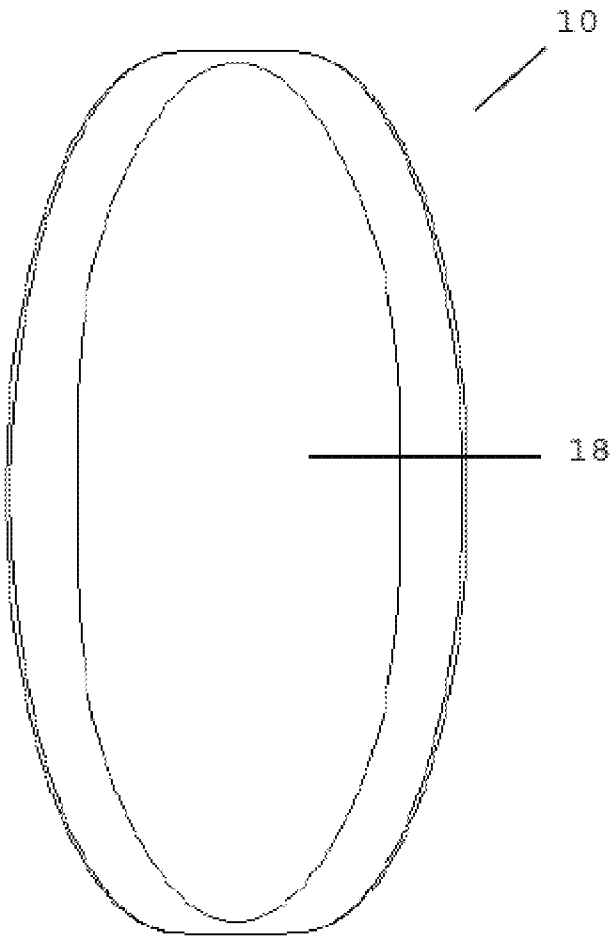
FIG. 4A is a rear view of the finger guard of FIG. 1.
Figure 4B:
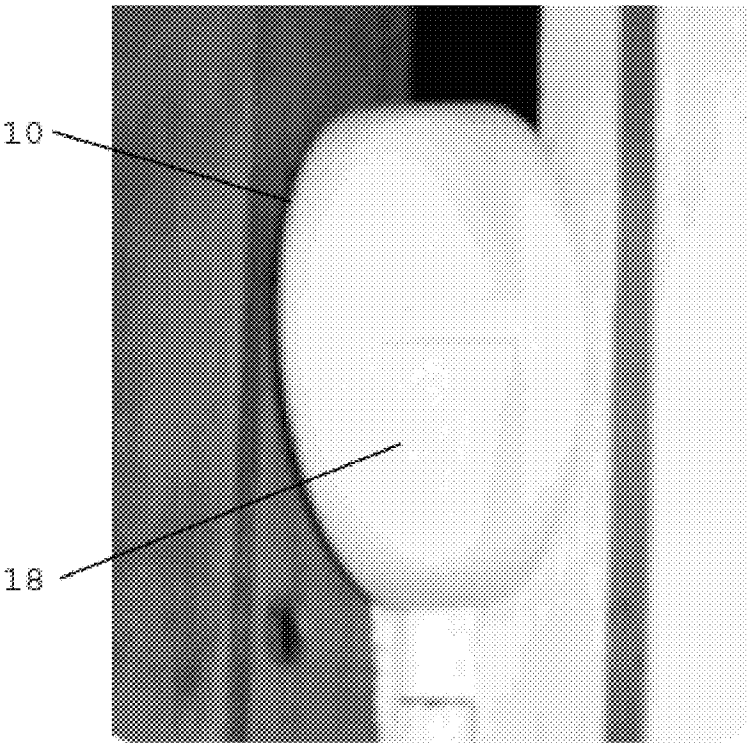
FIG. 4B is a rear view of the finger guard of FIG. 1 in operation.
Figure 5:
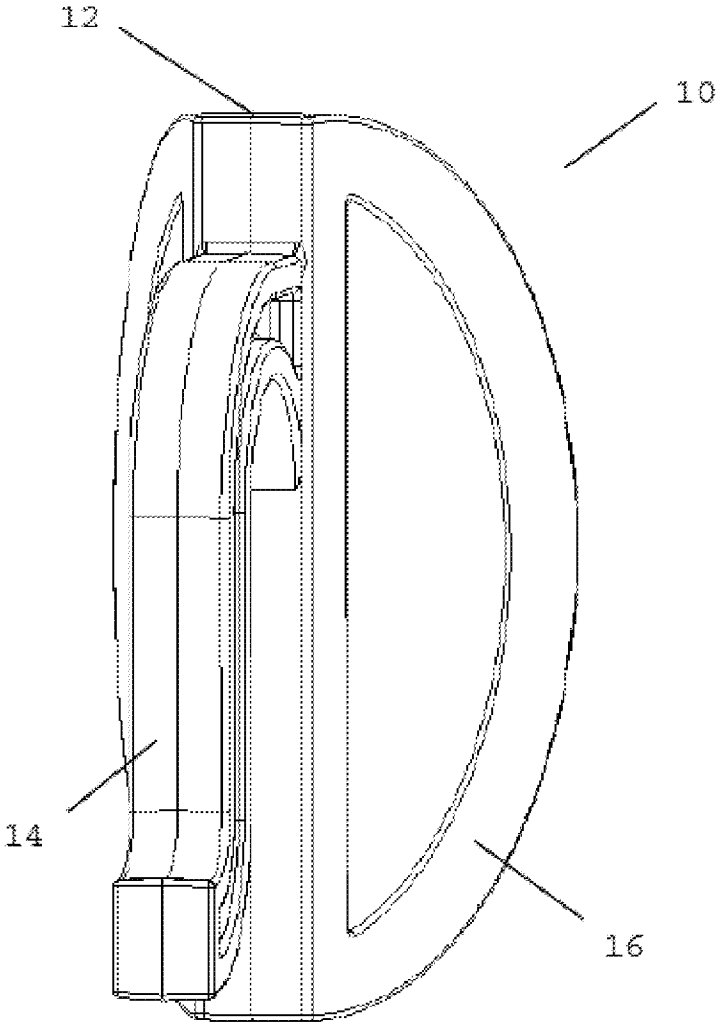
FIG. 5 is a front perspective view of the finger guard of FIG. 1.
Figure 9:
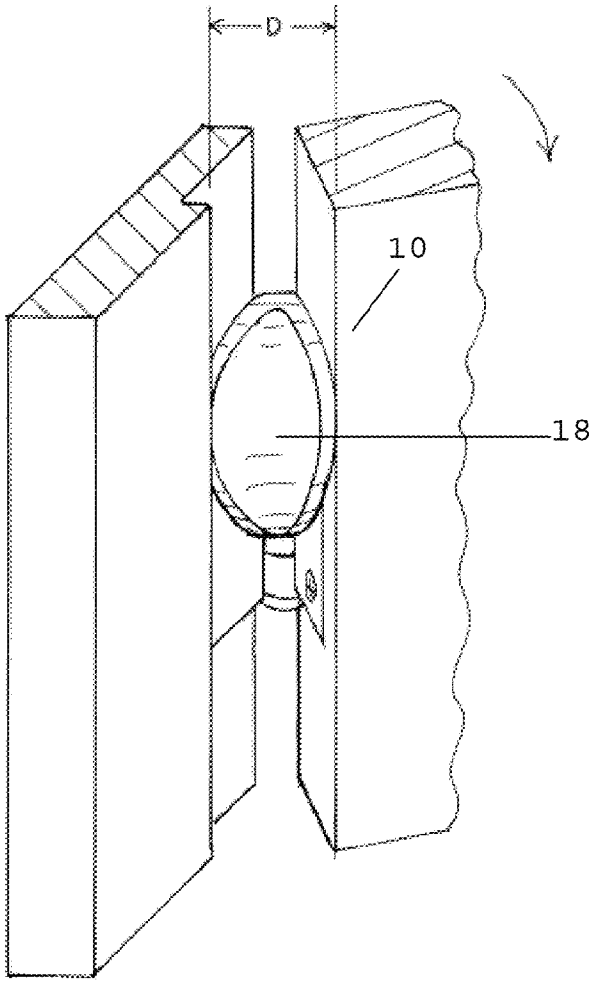
FIG. 9 is a rear view of a finger guard in use.

Referring to FIG. 1, the wedge 12 has at least three surfaces, two of which are on the side 16 of the wedge 12 and come into contact with either the longitudinal inner edge of the door or the inner edge of the door jamb when the device 10 is installed on a door. As depicted in FIG. 2, the two surfaces 16 can each have a curved outward edge 20, 22 as well as a substantially linear inward edge 24*a* and 24*b*, wherein the inward edges 24*a* and 24*b* are in contact with each other. The inward edges 24*a* and 24*b* can each have a first end 30 and a second end 32. The third surface 18 bridges the first and second surfaces 16 (FIG. 2) and faces outwardly (FIGS. 4A and 4B) when the finger guard 10 is installed. The size and shape of the device 10 is such that the protuberance 14 and a portion of the wedge 12 extend into the gap, the rest of the finger guard 10 being too large to pass through the gap. The narrowest part of the wedge 12 is located where the first and second surfaces 16 meet. As shown in FIG. 9, the third surface 18 of the wedge 12 is wide enough to prevent the gap from becoming narrow enough to injure fingers.

Figure 6:
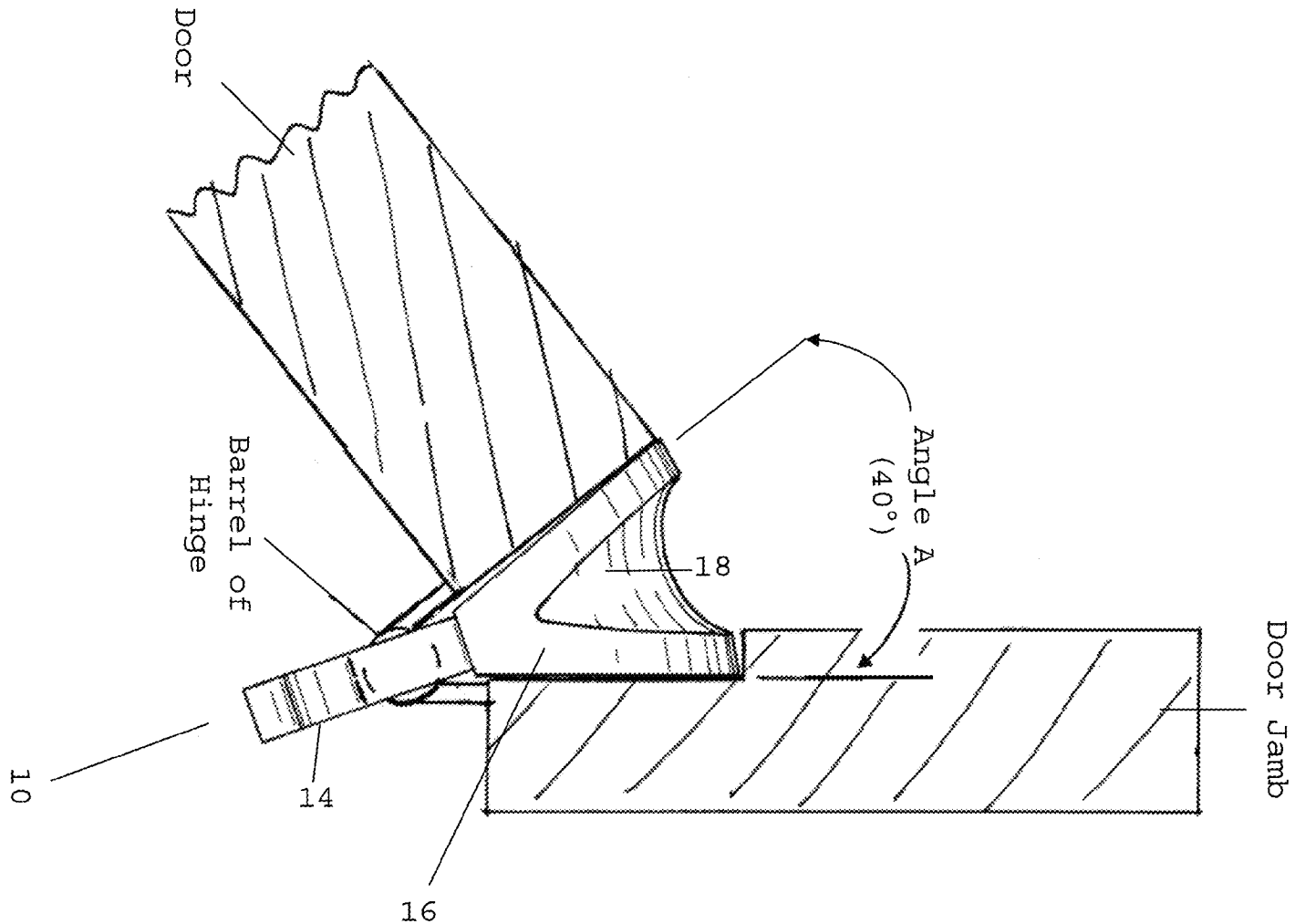
FIG. 6 is a top view of the finger guard of FIG. 1.

In one embodiment, the first, second, and third surfaces 16, 18 of the wedge 12 are optionally recessed, although only one or two of them could be recessed. Referring to FIG. 2, the side recesses 28 provide a place for one's fingers to grip the finger guard 10 during installation. As depicted in FIG. 2, the side recesses 28 can be concave relative to a perimeter 26 of the side recesses. The recessed third surface 18 shown in FIGS. 2 and 6 provides a place for larger hands (adults) to grip the device 10 while installing or removing it, but can prevent smaller hands (e.g., from small children) that cannot span the length of the device 10 from removing it once it has been installed.

Figure 3:
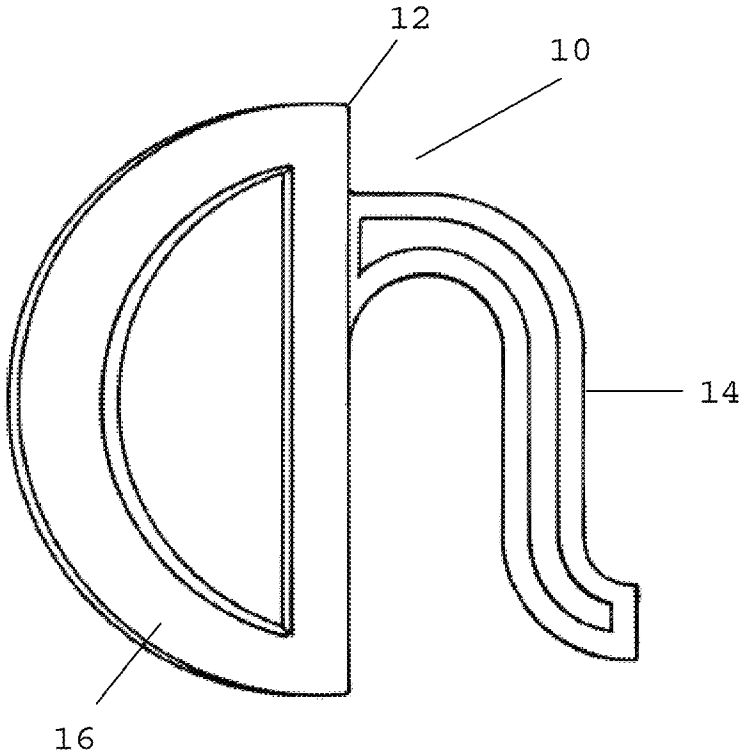
FIG. 3 is a side view of the finger guard of FIG. 1.

FIG. 1 shows that the protuberance 14 extends outwardly and downwardly from the point at which the first and second surfaces 16 meet. The protuberance 14 is sized and shaped to anchor the device 10 in place over the door hinge. In one aspect, the protuberance 14 extends outwardly from the point at which the first and second surfaces 16 meet, and downwardly down the length of the wedge 12. The protuberance can be substantially cane shaped, substantially S shaped, or any shape capable of anchoring the device 10 to the door hinge. The protuberance 14 can begin anywhere along the length of the wedge 12 and be any size provided the placement and size allow the protuberance 14 to support and anchor the device 10 when installed. For example, referring to FIGS. 1-3, the protuberance 14 can begin along the top third portion of the wedge 12.

The finger guard 10 can be made as a single piece, or the wedge 12 and protuberance 14 portions can be tooled separately and permanently or semi-permanently joined by means known in the art. The device 10 can be made of a material that is soft to the touch and gives slightly under pressure to prevent wear and damage to the device 10, doors, frames, hinges, and jambs. However, the material is also durable enough to allow the device 10 to substantially maintain its shape when the device 10 is installed and pressure is put on the door. In one embodiment, the finger guard 10 is made of rubber, plastic, polymer, or elastomer, and can be made, for example, with any suitable molding process. In one embodiment, the finger guard 10 is made from thermoplastic elastomer.

The wedge and protuberance can be connected together, or can be a unitary, monolithic, molded piece. The device has appropriate size in the wedge, the protuberance, and the gap between the wedge and the protuberance to fit over a hinge in a typical door. A shown in FIG. 6, the wedge forms an acute angle, e.g., between about 30-60 degrees, or between about 40-50 degrees, or about 40-45 degrees.

As will be apparent, the embodiments of the present invention can be embodied in forms other than those specifically disclosed above, such as variations in the shapes. The particular embodiments described above are, therefore, to be considered as illustrative and not restrictive.

What is claimed is:

1. A finger guard device for hanging on a door hinge that is connected to a door and to a door jamb comprising:

a wedge including:

a first surface with a first outward edge and a first inward edge, a second surface skewed relative to the first surface and having a second outward edge and a second inward edge, the second inward edge meeting the first inward edge of the first surface, and a third surface bridging the first outward edge of the first surface and the second outward edge of the second surface, wherein at least one of the first surface and the second surface includes a first recessed depression that is recessed relative to a perimeter of the at least one of the first surface and the second surface; and wherein the third surface includes a second recessed depression that is concave relative to a perimeter of the third surface a protuberance extending outwardly from the first inward edge of the first surface and the second inward edge of the second surface and then extending downwardly to create a shape such that the wedge and protuberance can hang on a hinge and prevent the door connected to the door hinge from closing.

2. The finger guard device of claim 1, wherein the first and second outward edges form substantially identical arcs and extend from a first end of the respective first and second inward edges to a second end of the respective first and second inward edges.

3. The finger guard device of claim 1, wherein the protuberance extends outwardly from a top third of the first inward edge of the first surface and a top third of the second inward edge of the second surface, and includes a first curved portion and a second straight portion continuing from the first curved portion and extending substantially parallel to the first and second inward edges.

4. The finger guard device of claim 1, wherein the angle between the first surface and the second surface at the meeting of the first inward edge of the first surface and the second inward edge of the second surface is between about 30 and 60 degrees.

5. The finger guard device of claim 1, wherein the finger guard is made of one of rubber, plastic, polymer, or elastomer.

6. The finger guard device of claim 1, wherein the finger guard device is made of one monolithic piece.

7. The finger guard device of claim 1, wherein the finger guard is made of thermoplastic elastomer.

8. The finger guard of claim 1, wherein the first and second surfaces each include the recessed depression.

9. A method of preventing injury caused by free-swinging motion of a hinged door using the finger guard device of claim 1, the door having a longitudinal inner edge and being attached with a hinge to a door jamb having a longitudinal inner edge, the method comprising: when the hinged door is at least partially open to create a gap between the longitudinal inner edge of the door and the longitudinal inner edge of the door jamb, providing the finger guard device into the gap such that the finger guard device straddles the door hinge, the wedge extending down a first side of the hinge and the protuberance extending down a second side of the hinge, so that the door is held in at least a partially open position and the gap remains between the longitudinal inner edge of the door and the longitudinal inner edge of the door jamb.

10. The method of claim 9, wherein the hinged door has two or more hinges and the finger guard device straddles the top-most hinge of the two or more hinges.

11. A finger guard device for hanging on a door hinge connected to a door and a door jamb comprising:

a wedge including:

a first surface with a first outward edge and a first inward edge, a second surface skewed relative to the first surface with a second outward edge and a second inward edge, the second inward edge meeting the first inward edge of the first surface, and a third surface bridging the first outward edge of the first surface and the second outward edge of the second surface, wherein at least one of the first surface and the second surface includes a first recessed depression that is recessed relative to a perimeter of at least one of the first surface and the second surface the; and wherein the third surface includes a second recessed depression that is concave relative to a perimeter of the third surface a protuberance extending from the wedge to create a shape such that the wedge and protuberance can hang on a hinge and prevent the door connected to the door hinge from closing.

12. The finger guard device of claim 11, wherein the first and second outward edges form substantially identical arcs and extend from a first end of the respective first and second inward edges to a second end of the respective first and second inward edges.

13. The finger guard device of claim 11, wherein the protuberance extends outwardly and from a top third of the first inward edge of the first surface and a top third of the second inward edge of the second surface, and then downwardly, and includes a first curved portion and a second straight portion extending from the curved portion and being substantially parallel to the first and second inward edges.

14. The finger guard device of claim 11, wherein the angle between the first surface and the second surface at the meeting of the first inward edge of the first surface and the second inward edge of the second surface is between about 30 and 60 degrees.

15. The finger guard device of claim 11, wherein the finger guard is made of one of rubber, plastic, polymer, or elastomer.

16. The finger guard device of claim 11, wherein the finger guard device is made of one monolithic piece.

17. The finger guard device of claim 11, wherein the finger guard is made of thermoplastic elastomer.

18. The finger guard device of claim 11, wherein the perimeter of the depression has a shape that is substantially similar to a perimeter shape of at least one of the first and second surfaces.

19. The finger guard device of claim 18, wherein the third surface has a depressed portion that is formed as a curved surface extending from the first outer edge to the second outer edge.

* * * * *